US006623098B2

(12) United States Patent
Davis

(10) Patent No.: US 6,623,098 B2
(45) Date of Patent: Sep. 23, 2003

(54) POSITIVE STOP CAPPING SYSTEM FOR INKJET PRINTHEADS

(75) Inventor: Jeremy A. Davis, Battle Ground, WA (US)

(73) Assignee: Hewlett-Packard Company, L.P., Houston, TX (US)

( * ) Notice: Subject to any disclaimer, the term of this patent is extended or adjusted under 35 U.S.C. 154(b) by 126 days.

(21) Appl. No.: 10/003,585

(22) Filed: Oct. 31, 2001

(65) Prior Publication Data

US 2003/0081049 A1 May 1, 2003

(51) Int. Cl.[7] ..... B41J 2/165
(52) U.S. Cl. ..... 347/29; 342/32
(58) Field of Search ..... 347/32, 29, 22

(56) References Cited

U.S. PATENT DOCUMENTS

| | | | | |
|---|---|---|---|---|
| 5,146,243 A | | 9/1992 | English et al. | 347/29 |
| 5,448,270 A | | 9/1995 | Osborne | 347/29 |
| 5,712,668 A | | 1/1998 | Osborne et al. | 347/32 |
| 5,867,184 A | | 2/1999 | Quintana | 347/29 |
| 5,936,647 A | | 8/1999 | Rhodes et al. | 347/29 |
| 5,956,053 A | | 9/1999 | Michael | 347/29 |
| 5,980,018 A | | 11/1999 | Taylor et al. | 347/31 |
| 6,132,026 A | | 10/2000 | Taylor et al. | 347/32 |
| 6,135,585 A | | 10/2000 | Johnson et al. | 347/32 |
| 6,158,838 A | * | 12/2000 | Capurso | 347/28 |
| 6,196,658 B1 | | 3/2001 | Rhodes et al. | 347/29 |
| 6,209,983 B1 | | 4/2001 | Osborne et al. | 347/32 |
| 6,220,689 B1 | | 4/2001 | Sturgeon | 347/29 |
| 6,312,091 B1 | | 11/2001 | Quintana | 347/29 |
| 6,497,471 B1 | * | 12/2002 | Gargir | 347/28 |
| 2001/0001559 A1 | | 5/2001 | Rhodes et al. | |

FOREIGN PATENT DOCUMENTS

WO WO98/18634 5/1998

OTHER PUBLICATIONS

Hewlett–Packard Company patent application, Ser. No. 09/639,729, filed Aug. 16, 2000, titled "Replaceable Capping System For Inkjet Printheads."

* cited by examiner

*Primary Examiner*—Thinh Nguyen

(57) ABSTRACT

A positive stop capping system is provided for sealing an inkjet printhead in an inkjet printing mechanism during periods of printing inactivity. A positive stop or brace is provided in a cavity defined under a cap cover skin, with the skin also forming a sealing lip which surrounds ink-ejecting nozzles of the printhead when sealed. The flexible skin supporting the lip deflects into the cavity toward the brace when the cap is moved into a sealing position, in some cases contacting the brace, and in other cases, compressing the brace. An inkjet printing mechanism having the positive stop capping system and method of capping using this system are also provided.

21 Claims, 5 Drawing Sheets

POSITIVE STOP CAPPING SYSTEM FOR INKJET PRINTHEADS

INTRODUCTION

The present invention relates generally to inkjet printing mechanisms, and more particularly to a positive stop capping system for sealing an inkjet printhead during periods of printing inactivity.

Inkjet printing mechanisms use pens which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which hermetically seals the printhead nozzles from contaminants and drying. To facilitate priming, some printers have priming caps that are connected to a pumping unit to draw a vacuum on the printhead. During operation, partial occlusions or clogs in the printhead are periodically cleared by firing a number of drops of ink through each of the nozzles in a clearing or purging process known as "spitting." The waste ink is collected at a spitting reservoir portion of the service station, known as a "spittoon." After spitting, uncapping, or occasionally during printing, most service stations have a flexible wiper, or a more rigid spring-loaded wiper, that wipes the printhead surface to remove ink residue, as well as any paper dust or other debris that has collected on the printhead.

During periods of printing inactivity, inkjet printheads are typically capped to prevent them from drying out, with the capping reducing evaporation of the ink components, as well as to protect the printhead from contamination due to environmental factors, such as dust, paper particles and the like. To form a good seal, the cap must conform to the printhead and supply enough force against the printhead to limit air transfer. Traditionally, capping has been accomplished using a compliant elastomer that is pressed against the printhead to create a complete seal.

A variety of different tolerance variations occur in the manufacture of inkjet printers, as well as the inkjet cartridges or pens which are installed in these printers, leaving service station designers the task of accommodating these varying tolerances while still providing adequate printhead servicing and high quality print output. The printhead cap designer has a particularly difficult task, needing to maintain an adequate hermetic seal around printheads which may be at varying heights, that is, the distance between the cap sled and the planes within which each of the printhead orifice plates lie. For instance, there may be tolerance variations in the pens themselves, or in the carriage datums, a pen may not be fully seated in the carriage, or a combination of these factors may be work. In multi-pen printers, these variations lead to extra challenges in providing adequate capping force on the higher printheads, while not providing excessive force on the lower printheads. Please note while the terms "higher" and "lower" are used here by way of reference for a printhead which shoots ink drops downwardly, the same principles apply if the printheads were to shoot the ink drops horizontally or on some other plane, with the term "high" being used to indicate a greater cap-to-printhead distance, and the term "low" being used to indicate a shorter cap-to-printhead distance. Excessive capping forces may lead to printhead damage, or unseating the pen from the carriage datums. Inadequate capping forces lead to an inadequate cap seal allowing air to enter the capping region and dry out the ink, or lead to severely blocked or occluded nozzles.

Some capping designs used separate springs located under each cap, for instance as shown in U.S. Pat. Nos. 5,867,184 and 5,956,053, currently assigned to the present assignee, the Hewlett-Packard Company. Unfortunately, these systems required separate cap bases, separate elastomeric caps on the bases, cap venting components, and springs for each cap assembly, which not only increases the parts cost, but also the assembly labor cost required to assemble a printer. A unitary capping system was proposed in U.S. Pat. No. 6,220,689 which used a single elastomeric capping structure having four separate caps formed thereon to seal four printheads in a printer. However, this unitary capping design while eliminating the separate caps, cap bases and springs for each printhead, thereby reducing part count, unfortunately was unable to adequately accommodate varying printhead heights to achieve adequate sealing, while avoiding excessive capping forces.

DRAWING FIGURES

FIGS. 3 and 4 are enlarged sectional views of the capping system of FIG. 2, taken along lines 3—3 thereof for sealing two printheads, with:

Figure 3:
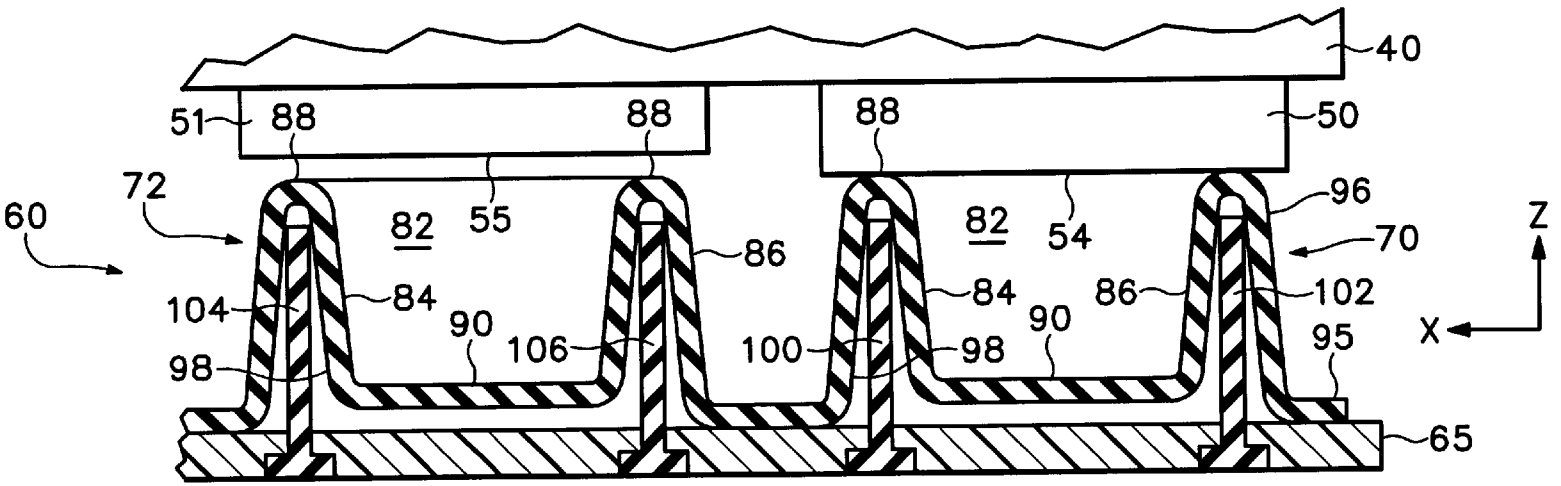

FIG. 3 showing a first stage of the capping process; and

Figure 4:
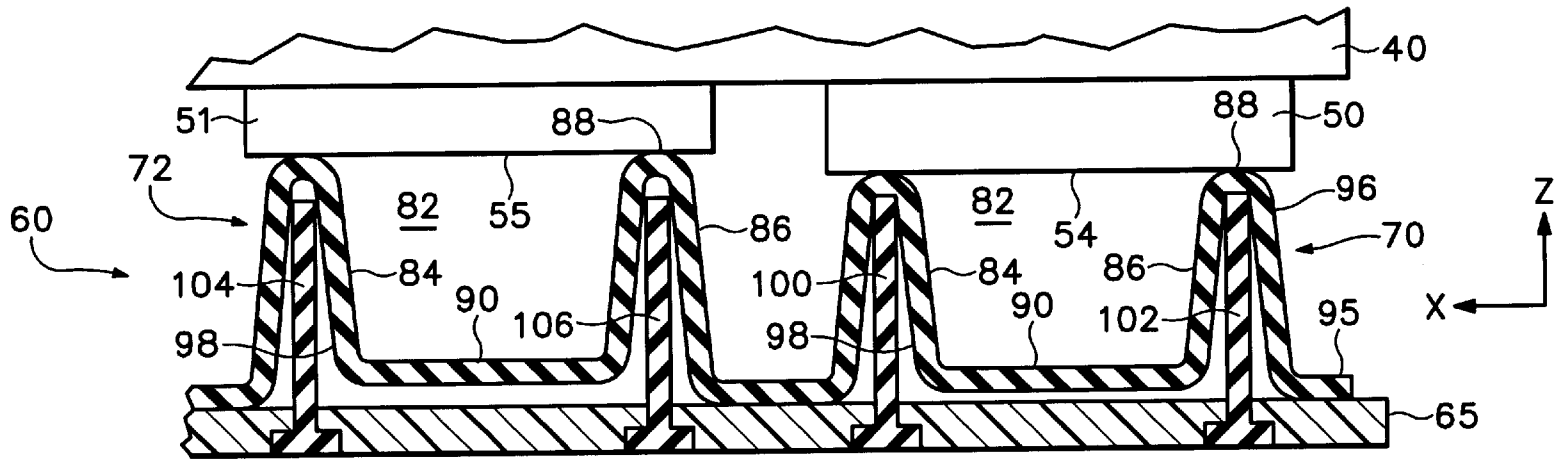

FIG. 4 showing a second stage of the capping process.

Figure 1:
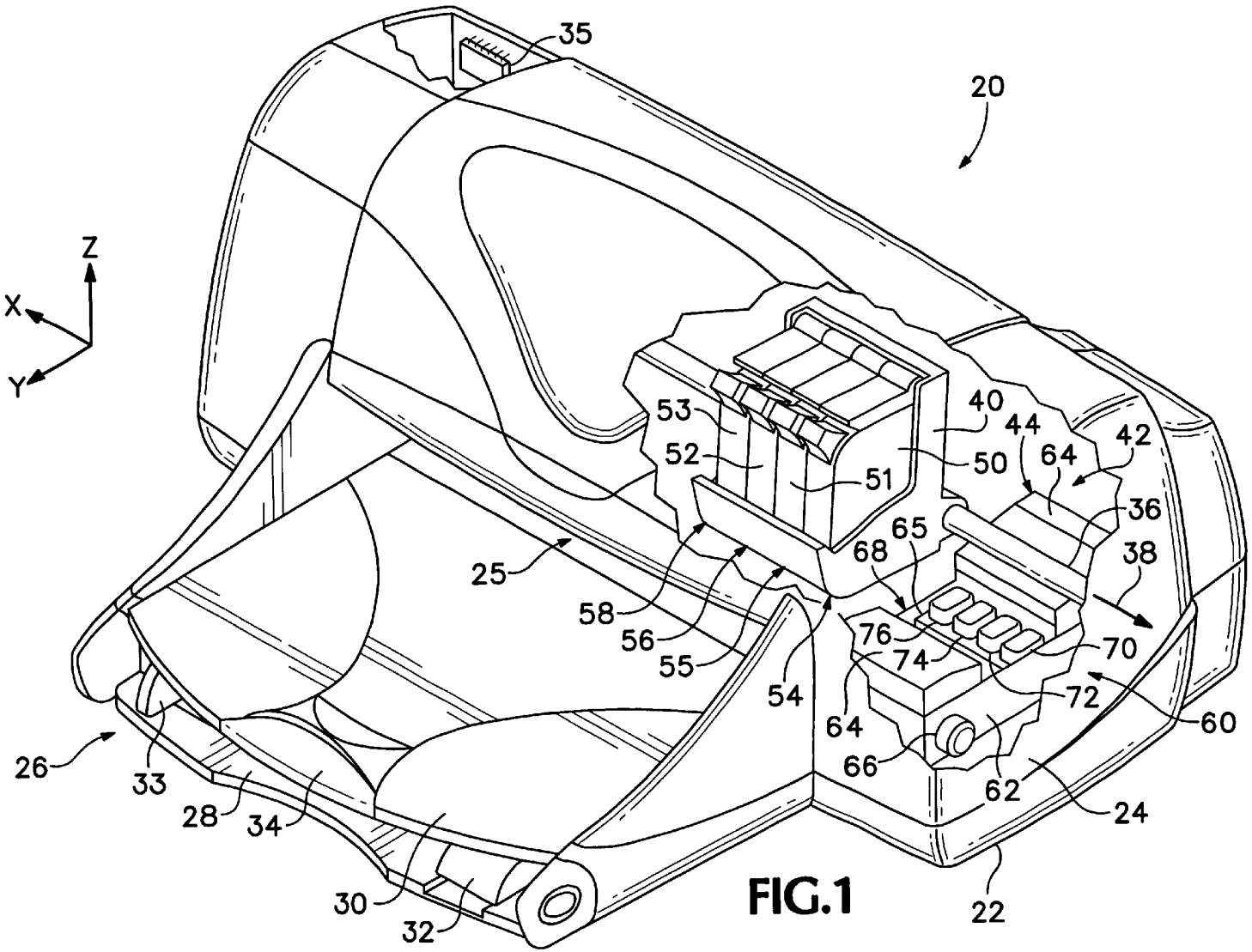
FIG. 1 is a perspective view of an inkjet printing mechanism, here shown as an inkjet printer, having a printhead service station with one form of a positive stop capping system of the present invention.
Figure 2:
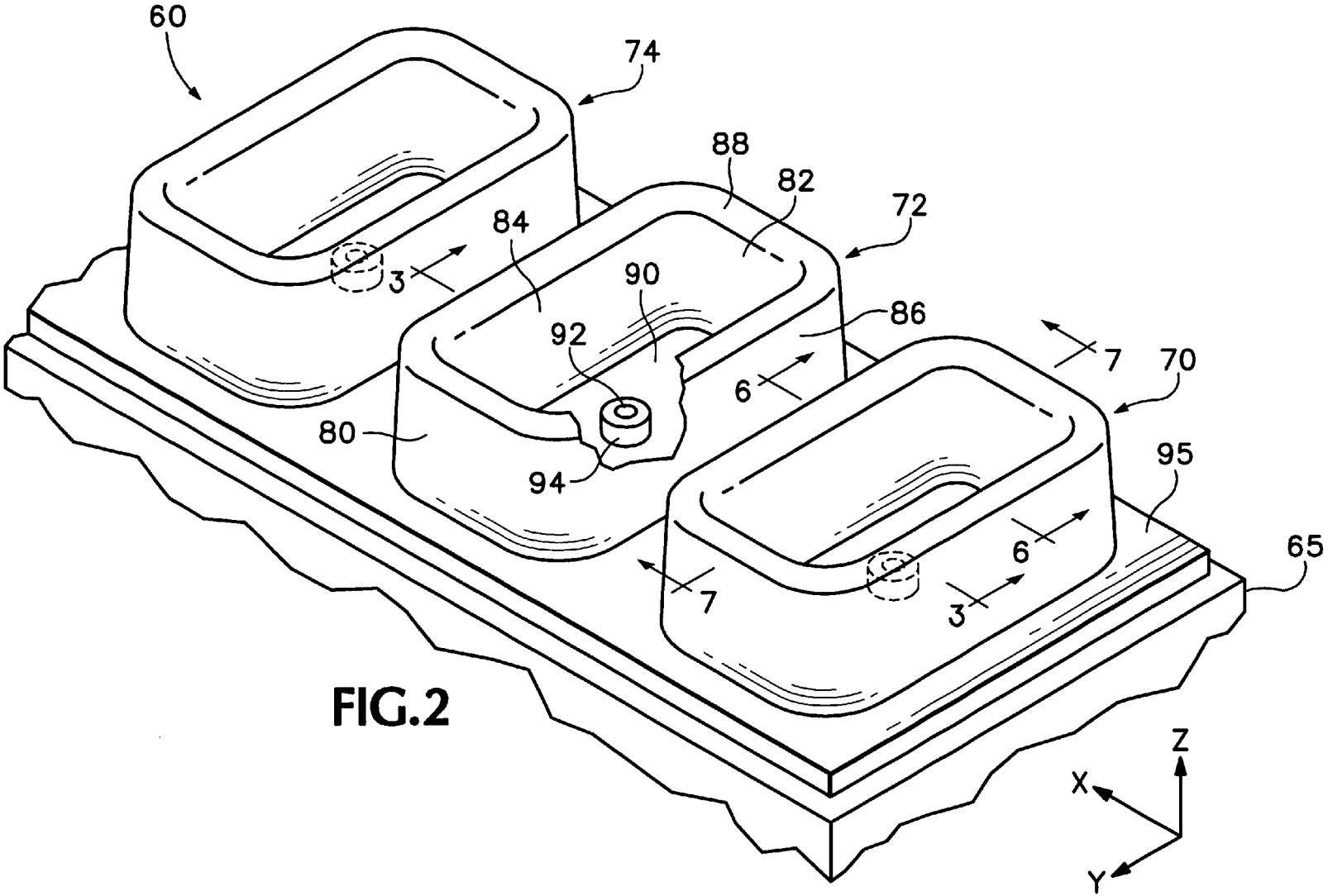
FIG. 2 is an enlarged perspective view of a portion of the positive stop capping system of FIG. 1.
Figure 5:
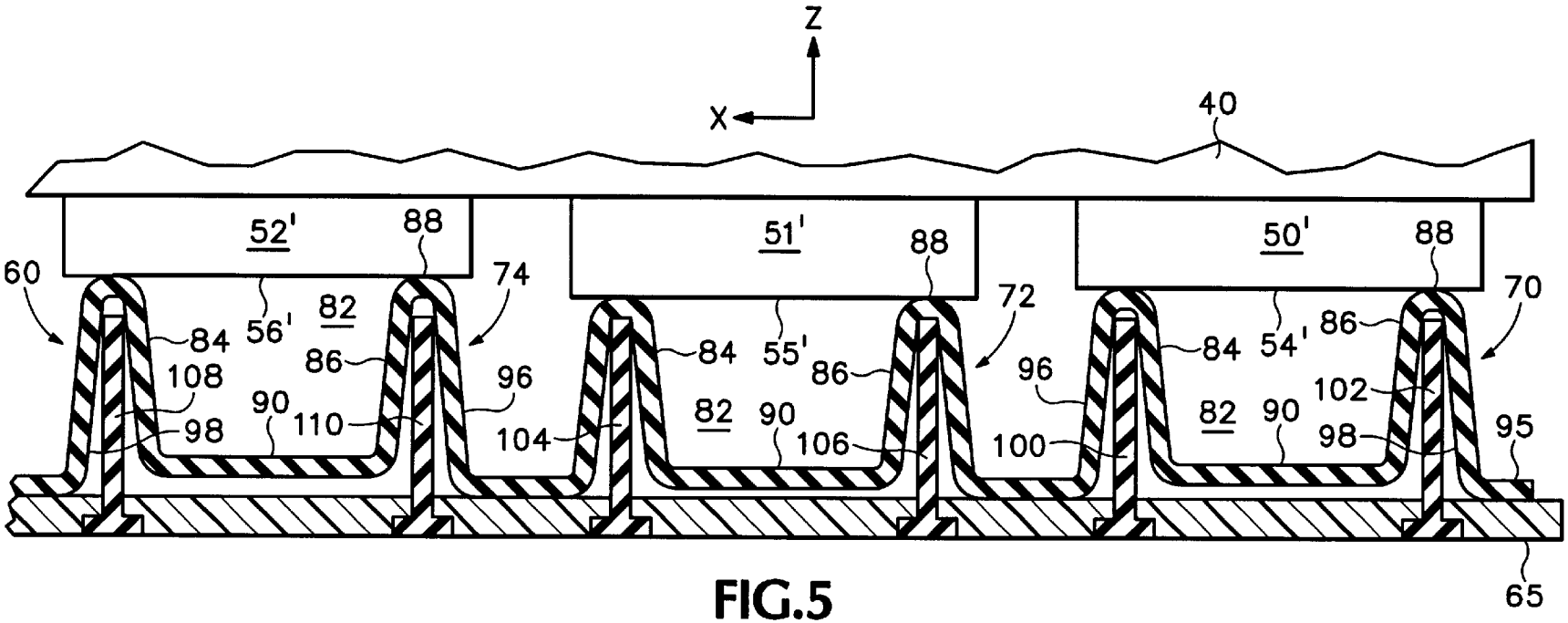

FIG. 5 is an enlarged sectional view taken along the same plane defined by sectional lines 3—3 of FIG. 2, here showing three printheads being sealed by the positive stop capping system of FIG. 1.

Figure 6:
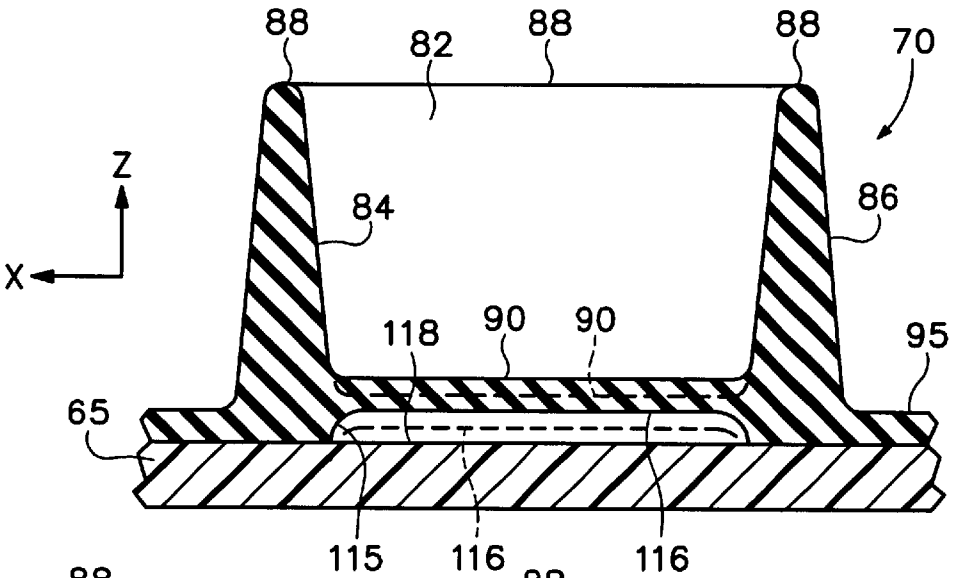

FIG. 6 is an enlarged sectional view of an alternate embodiment of the positive stop capping system of the present invention, taken along lines 6—6 of FIG. 2.

Figure 7:
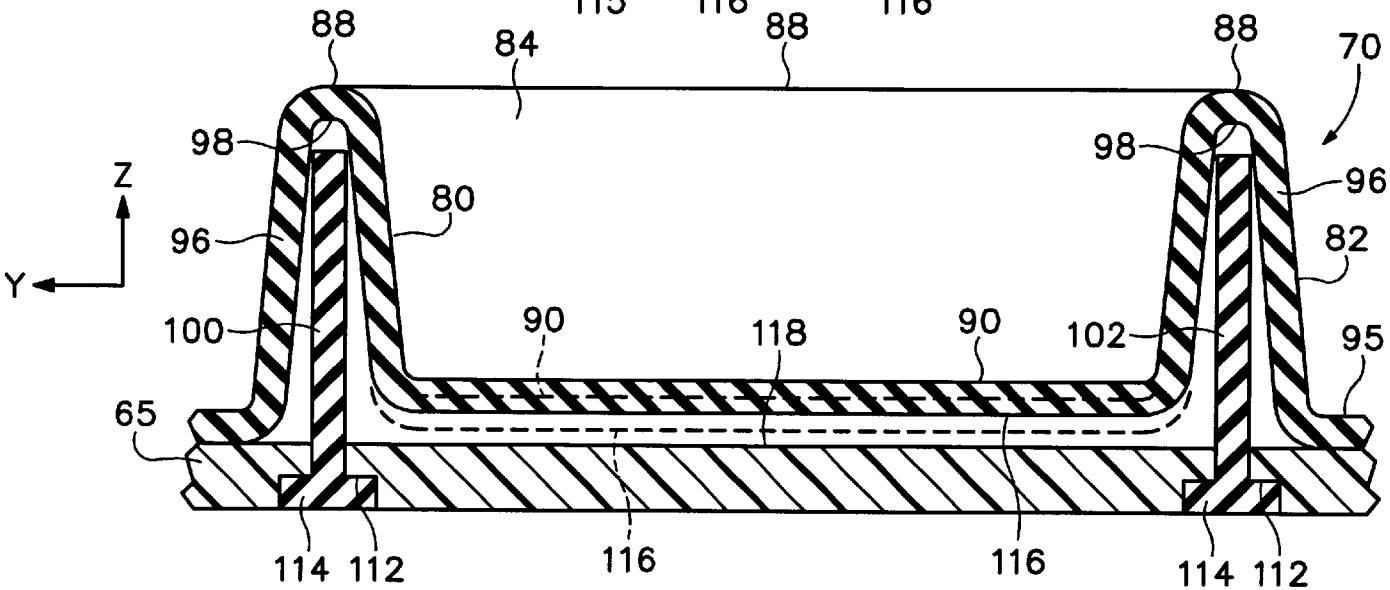

FIG. 7 is an enlarged sectional view of the alternate embodiment of FIG. 6, taken along lines 7—7 of FIG. 2.

DETAILED DESCRIPTION

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, facsimile machines, copiers, all-in-one combination units (for printing, copying, scanning and faxing), cameras, and video printers, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material. Sheets of print media are fed through a printzone 25 by an adaptive print media handling system 26, constructed in accordance with the present invention. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional motor-driven paper drive rollers (not shown) may be used to move the print media from tray 28 into the printzone 25 for printing. After printing, the sheet then lands on output tray portion 30. The media handling system 26 may include a series of adjustment mechanisms for accommodating different sizes of print media, including letter, legal, A-4, envelopes, etc., such as a sliding length and width adjustment levers 32 and 33 for the input tray, and a sliding length adjustment lever 34 for the output tray.

The printer 20 also has a printer controller, illustrated schematically as a microprocessor 35, that receives instructions from a host device, typically a computer, such as a personal computer (not shown). Indeed, many of the printer controller functions may be performed by the host computer, by the electronics on board the printer, or by interactions therebetween. As used herein, the term "printer controller 35" encompasses these functions, whether performed by the host computer, the printer, an intermediary device therebetween, or by a combined interaction of such elements. The printer controller 35 may also operate in response to user inputs provided through a key pad (not shown) located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 36 is mounted to the chassis 22 to define a scanning axis 38. The guide rod 36 slideably supports a reciprocating inkjet carriage 40, which travels back and forth across the printzone 25 and into a servicing region 42. Housed within the servicing region 42 is a service station 44, which will be discussed in greater detail below with respect to the present invention. The illustrated carriage 40 carries four inkjet cartridges or pens 50, 51, 52 and 53 over the printzone 25 for printing, and into the servicing region 42 for printhead servicing. Each of the pens 50, 51, 52 and 53 have an inkjet printhead 54, 55, 56 and 58, respectively, which selectively eject droplets of ink in response to firing signals received from the controller 35.

One suitable type of carriage support system is shown in U.S. Pat. No. 5,366,305, assigned to Hewlett-Packard Company, the assignee of the present invention. A conventional carriage propulsion system may be used to drive the carriage 40, including a position feedback system, which communicates carriage position signals to the controller 35. For instance, a carriage drive gear and DC motor assembly may be coupled to drive an endless belt secured in a conventional manner to the pen carriage 40, with the motor operating in response to control signals received from the printer controller 35. To provide carriage positional feedback information to printer controller 35, an optical encoder reader may be mounted to carriage 40 to read an encoder strip extending along the path of carriage travel.

In the printzone 25, the media sheet receives ink from the inkjet cartridges 50–53, such as the black ink cartridge 50, the yellow ink cartridge 51, the magenta ink cartridge 52, and/or the cyan ink cartridge 53. The cartridges 50–53 are also often called "pens" by those in the art. While the pens 50–53 may contain pigment based inks, dye-based inks, thermoplastic, wax or paraffin based inks, as well as hybrid or composite inks having both dye and pigment characteristics. The illustrated pens 50–53 each include reservoirs for storing a supply of ink.

The printheads 54–58 each have an orifice plate with a plurality of nozzles formed therethrough in a manner known to those skilled in the art. The illustrated printheads 54–58 are thermal inkjet printheads, although other types of printheads may be used, such as piezoelectric printheads. Indeed, the printheads 54–58 typically include a substrate layer having a plurality of resistors which are associated with the nozzles. Upon energizing a selected resistor, a bubble of gas is formed to eject a droplet of ink from the nozzle and onto media in the printzone 25. The printhead resistors are selectively energized in response to enabling or firing command control signals, which may be delivered by a conventional multi-conductor strip (not shown) from the controller 35 to the printhead carriage 40, and through conventional interconnects between the carriage and pens 50–53 to the printheads 54–58.

FIG. 1 also shows the service station 44 as having one form of a positive stop capping system 60, constructed in accordance with the present invention. The service station 44 includes a lower base portion 62, an upper bonnet portion 64, and a moveable cap sled 65 which is sandwiched therebetween. A motor and gear assembly 66 is used to drive the sled 65 in a forward direction along the positive Y-axis, as well as in a rearward direction along the negative Y-axis. During this forward and rearward motion, the sled 65 may include a feature which engages the printhead carriage 40 to move the capping system 60 from a lowered rest position shown in FIG. 1, to an elevated printhead sealing position (see FIGS. 3–5), which may be accomplished in a variety of different manners, such as using a spring-biased four bar linkage, as disclosed in U.S. Pat. Nos. 5,980,018 and 6,132,026. Indeed, other mechanisms may be used to elevate the sled 60 from a rest position to a capping position, such as through the use of ramps, solenoids, carriage motion, as well as a variety of other mechanisms known to those skilled in the art.

The sled 65 may also be moved under the service station bonnet 64 to make an ink spittoon 68, which is housed within the base 62, accessible to the inkjet printheads 54–58 for ink purging or spitting. The sled 65 carries four printhead caps 70, 72, 74 and 76, which are used to seal the printheads 54, 55, 56 and 58, respectively. The sled 65 may also carry other servicing components, such as wipers, solvent applicators, or primers, to name a few. The caps 70-76 may be constructed of a resilient, non-abrasive, elastomeric material, such as nitrile rubber, silicone, ethylene polypropylene diene monomer (EPDM), or other comparable materials known in the art.

Turning now to FIG. 2, each of the caps 70–76 has the same construction, with a front wall 80 an opposing rear wall 82, an inboard sidewall 84, and an opposing outboard sidewall 86, which are joined at the corners to form a roughly rectangular shaped sealing lip 88 in the illustrated embodiment. As used herein, the term "inboard" refers to components facing in the positive X-axis direction, toward printzone 25, while the term "outboard" refers to the opposite direction, that is, in the negative X-axis direction, toward the servicing region 42. The shape of the sealing lip 88 is rectangular in the illustrated embodiment with rounded corners, to provide an adequate seal for printheads 54–58, which each have two sets of linear nozzle arrays. It is apparent that the sealing lip may take other shapes in different implementations having other nozzle configurations.

The interior surfaces of the cap walls 80-86 may blend into a cap floor 90, which has a vent hole 92 extending therethrough. Preferably the vent hole 90 is surrounded by a neck portion 94 which projects upwardly from the cap floor 90, as described in U.S. Pat. No. 5,956,053, currently assigned to the present assignee, the Hewlett-Packard Company. The vent hole 92 may be coupled to a labyrinth vent path (not shown) underneath the cap floor 90, eventually leading to atmosphere. The neck portion 94 serves to prevent any ink spillage or ink drool from the pens, which may accumulate along the cap floor 90, from immediately spilling down the vent hole 92, thereby avoiding blockages of the atmospheric vent passageway with liquid or dried ink. Preferably each of the caps 70–76 are unitarily molded to extend up from a cap base 95, which is of the same elastomer as the caps, such as EPDM. In this embodiment, the cap base 95 is supported by the cap sled 65.

FIG. 3 is a cross-sectional view of caps 70 and 72 shown at the beginning of a capping sequence for sealing printheads 54 and 55, respectively of pens 50 and 51. In FIG. 3, we see that pen 50 is seated lower in carriage 40 than pen 55, perhaps due to manufacturing tolerances accumulated within the individual pens 50 and 51, variations in the pen seating datums of carriage 40, and/or variations in the degree to which pens 50 and 51 are seated within carriage 40. For instance, pen 51 may not be seated as tightly against the carriage datums as pen 50. Recall that while the illustrated embodiment shows the printheads 54 and 55 in a vertical plane to eject inks downwardly, in other embodiments the pens may be placed at other angles, for instance with the printheads being in a vertical plane to shoot droplets horizontally onto a vertical sheet of media. Furthermore, these concepts may also be applied to any other angular orientation of the printheads and media between these horizontal and vertical extremes.

FIG. 3 also shows the internal construction of the caps 70 and 72, as each having an outer cap skin 96 defining an interior lip chamber 98 underneath the sealing lip 88. Located within the lip chamber 98 of the inboard and outboard walls 84 and 86 of cap 70 are a pair of brace portions or positive stop features 100 and 102, respectively. Similarly, within the lip chambers 98 of the inboard and outboard walls 84 and 86 of cap 72 are another pair of positive stop walls 104 and 106, respectively. The caps 74 and 76 may be constructed in the same manner as illustrated for cap 70 and 72, although it is apparent that in other implementations it may be desirable to have some caps with and other caps without interior positive stop features.

FIGS. 3 and 4 illustrate the capping process, where the cap sled 65 is elevated to bring the cap lips 88 into sealing contact with printheads 54, 55. In FIG. 3 we see printhead 54 achieving initial contact with the sealing lip 88 of cap 70, whereas cap 72 has not yet even contacted printhead 55. In FIG. 4, further elevation of the cap sled 65 has now brought the sealing lip 88 of cap 72 into contact with printhead 55. While sealing contact has been achieved with printhead 55, we see the cap skin 96 of cap 70 has been compressed until the interior surface of the skin opposite the sealing lip 88 is in contact with the upper surface of stops 100 and 102, with the lip chamber 98 having been effectively collapsed during the capping process. In earlier capping systems without the positive stops 100–106, such continued extreme compression of the cap walls may have caused the cap to deform and create an ineffective seal. Moreover, another goal of the positive stop capping system is to balance the force between the caps 70–76 as much as possible. The positive stop feature forces the cap compression to stop before any one of the caps can be over-compressed, thus assuring effective seals are obtained on all of the caps 70–76. The positive stops 100–106 may be composed of a number of different types of materials, including a more rigid elastomer than skin 96, a plastic, or other non-deflecting materials. Indeed, in some embodiments it may be preferable to allow the stops 100–106 to be slightly compressive, for instance, having a durometer on the Shore A scale of about 70–95, or more preferably, about 80–90, or a nominal value of 85+/–5. In such embodiments, the skin 96 may be constructed of an elastomer having a durometer on the Shore A scale of 30–60 with a more preferred range being between 40–55, or a nominal value of 50+/–5, with +/–5 being a standard manufacturing tolerance.

Thus, the rigidity of the positive stop elastomer may be controlled to allow for additional deflection if needed for accommodating extreme tolerance situations. In such a situation, when eventually the black pen 50 ran dry, it could be replaced with a pen having a printhead which sat at the level of printhead 55, and if using an earlier capping system, with the black cap may have taken a set in an over compressed state so the new pen would then be inadequately sealed. Use of the positive stops 100–106 allows the cap skin 96 to be selected of a softer durometer, and/or of a material which is not as likely to take a permanent set as the materials which were required when the caps were made of a solid elastomer. Moreover, use of the positive stops 100–106 in combination with the more flexible or ductile cap skin 96 allows the positive stop capping system 60 to be designed for sealing both maximum and minimum extremes of cap-to-printhead distance variations. That is, the positive stops 100–104 are of a height to seal a tolerance stack yielding an extreme lowest printhead position, here illustrated by printhead 54, while also dealing with the opposite tolerance stack extreme of the greatest cap-to-printhead distance or spacing, here illustrated by printhead 55.

FIG. 5 illustrates the capping position of three pens 50', 51' and 52', newly installed in place of pens 50, 51 and 52 shown in FIGS. 1, 3 and 4. Here we see that pen 51' now occupies the lowest or closest distance toward the cap sled 65, with the cap skin 96 resting on stops 104 and 106 of cap 72. The cap 74 as has within lip chambers 98 of the inboard and outboard side walls 84 and 86 positive stops 108 and 110, respectively, which may be constructed as described for stops 100–106. Printhead 56' of pen 52 is shown being sealed by lip 88 of cap 74, with very little compression of the lip chambers 98. At an intermediate position between the lowest and highest printheads 55' and 56' is the black printhead 54' which has its lip chambers 98 at a partially compressed state. When in the sealing position, the lip chambers 98 of the black printhead 54' are more compressed than chambers 98 of cap 74, and are less compressed than the fully compressed state of chambers 98 as shown for cap 72. Depending upon the orientation of the remaining printhead 58, the remaining cap 76, which has been omitted from FIG. 5, may take the lowest extreme position of cap 72, a minimal compressed position as shown for cap 74, or some intermediate position between these two extremes, such as that shown for the black cap 70.

FIGS. 6 and 7 illustrate an alternate interior construction which may be used for caps 70–76. In FIG. 6, we see the inboard and outboard sidewalls 84 and 86 are constructed purely of the cap skin elastomer, having a solid construction without the hollow interior lip chambers 98. FIG. 7 shows cross-sectional views of the front and rear walls 80 and 82 of cap 70 as having positive stops 100 and 102 within the lip chambers 98. Alternatively, in other implementations, it may be preferable to have the positive stops 100, 102 under only the sidewalls 84 and 86, for instance as shown in FIGS. 3–5, and to have the front and rear walls 80, 80 constructed of a solid elastomer as shown in FIG. 6. Furthermore, in other implementations, it may be desirable to have two or more positive stop segments located inside a wall, with the segments being separated by air pockets. Other variations in the location and spacing of the positive stops may be more preferable in other implementations, and those described herein are by way of illustration only.

FIGS. 3–5 and 7 show one manner of forming the stops 100, 102 using insert molding techniques. Referring to FIG. 7, the cap sled 65 has been formed with a pockets 112 for receiving an associated base or foot portion 114 of the stops 100 and 102. The cap base 95 and cap walls 80-84 may be a separately molded unitary piece of elastomer, which is then fit over the cap stops 100, 102 and adhered, bonded, clipped or otherwise attached to the cap sled 65, for instance in the manner described in U.S. Pat. No. 6,220,689, currently assigned to the present assignee, the Hewlett-Packard Company. Alternatively, the cap skins 96 for each cap 70–76 may be separately constructed and secured to the sled 65, although a unitary unit is preferred to lower the part count and assembly costs to provide consumers with a more economical printing unit.

FIGS. 6 and 7 show an alternate embodiment where the cap floor 90 does not touch the cap sled 65, which allows a cap expansion chamber 115 to be defined thereunder between a lower interior surface 116 of the cap floor 90 and an upper surface 118 of the cap sled 65. The expansion chamber 115 advantageously allows the cap floor 90 to expand downwardly into the expansion chamber 115, as shown in dashed lines in FIGS. 6 and 7, in the same manner as described in U.S. Pat. No. 5,146,243, currently assigned to the present assignee, the Hewlett-Packard Company. Free expansion of the cap floor 90 into chamber 115 prevents the pressure accumulated between the caps 70–76 and printheads 54–58 during the capping operation from de-priming the nozzles. Flexion of the cap floor 90 provides another path for the capping air to travel rather than upwardly into the nozzles.

Thus, using the positive stop capping system 60, a two-stage capping process occurs, where during the first stage, the printheads initially contact and compress the cap skin 96 after contacting the cap lips 88. In the extreme case, this compression of the lip chamber 98 reaches a final stage, where the interior of the cap skin 96 rests along two or more of the upper surfaces of stops 100–110. At this point, the cap skin 96 may also experience some compression if a soft durometer, compressible elastomer has been selected for the skin. Furthermore, if the positive stops 100–110 are of a compressible elastomer, a final portion of the capping stage may involve compressing the cap stops longitudinally, or in effect shortening their final stature from their rest or uncapped stature. Uncapping reverses this process, with the cap lips 88 returning to their original elevations after providing effective seals on all printheads 50–53, regardless of the tolerance stack accumulated which varies printhead height.

Fewer parts are needed to assemble the positive stop capping system 60 than the earlier capping systems described in the Introduction section above. During the first capping stage when a small amount of force is required to compress the chambers 98 under the cap skin 96, preferably, the caps 70–76 are designed so that all of the printheads will be sealed when one of the caps reaches the fully compressed state, as shown for cap 72 in FIG. 5. Moreover, the positive capping system 60 also allows sealing of printheads which are not co-planar with a plane defined by the sled 65, for instance if a pen were mounted at slight angle within the carriage 40, such as with the outboard side higher of the orifice plate being than the inboard side. In such a case, the inboard cap wall 84 would be compressed more than the outboard wall 86 to seal the pen, with the front and rear walls 80, 82 being compressed in an angular fashion with more compression at the inboard side than at the outboard side. Similarly, the cap 70–76 may also adequately seal over a printed orifice plate having ripples or other non-planar features as the lip 88 flexes to accommodate these irregularities. Thus, use of the positive stop capping system 60 allows a single elastomer including base 95 and caps 70–76 to seal multiple printhead orifice plates which have surface irregularities or which do not rest within the same plane when installed.

Furthermore, the two stage positive capping system 60 allows moving cap sled datuming or alignment, from alignment with carriage 40 to alignment with the actual pens 50–53 which are being capped. Traditionally, a hard stop has been used to control the maximum capping force, with a feature from sled 65 encountering a stopping feature on carriage 40 to prevent over-compression of the caps and/or applying excessive forces to the printheads. Using these more distal parts, such as the cap sled and carriage, for which this datuming also then needed to accommodate tolerance variations between the carriage and service station frame 60, as well as carriage/sled tolerance variations. By moving the datuming structure to the cap positive stops 100–110, this method moves the datuming structure to the cap/printhead intersection, which are the parts which are actually interacting with one another.

Furthermore, the positive stop capping system 60 provides a low force capping design which does not need to accommodate concerns of overtravel or excessive cap deflection, which in the past often resulted in the caps taking a permanent compressed set, and never returning to their initial relaxed or rest position, as discussed above. Additionally, the positive stop capping system 60 allows proper capping to occur even if one or more of the pens 50–53 are missing from carriage 40, for instance in the event of a black-only print job where the color pens 51, 52, 53 had been removed by a consumer while going to a store to pick up fresh pens. In previous capping systems, missing pens varied the four sectors presented to the remaining pen needing to be capped, often leaving the remaining pen to be either under-capped or over-capped. Sometimes the cap lip for the remaining pen would buckle, leaving an air leakage path. These unfortunate shortcomings of the earlier systems are avoided by using the positive stop capping system 60. And finally, the illustrated embodiments of FIGS. 1–7 are shown and described herein to illustrate the principles and concepts of the invention as set forth in the claims below, and a variety of modifications and variations may be employed in various implementations while still falling within the scope of the claims below.

I claim:

1. A capping system for sealing around ink-ejecting nozzles of a printhead in an inkjet printing mechanism, comprising:

a support movable between a sealing position and a rest position; and a cap extending from the support and having (a) an outer layer which defines a hollow interior portion and (b) a brace portion inside the hollow interior portion, with the outer layer terminating in a lip having an exterior surface which surrounds the nozzles when the support is in the sealing position, and with the lip having an interior surface spaced apart from the brace portion when the support is in the rest position, and the lip interior surface approaching toward the brace portion when the support is in the sealing position.

2. A capping system according to claim 1 wherein the brace portion extends entirely under said lip.

3. A capping system according to claim 1 wherein:

said outer layer defines a pair of opposing hollow interior portions; and the brace portion comprises a pair of brace portions each housed within an associated one of the pair of opposing hollow interior portions.

4. A capping system according to claim 3 wherein said outer layer is solid under said lip between said pair of opposing hollow interior portions.

5. A capping system according to claim 1 wherein:

the outer layer is of a first material having a first flexibility; and the brace portion is of a second material having a second flexibility which is less than said first flexibility.

6. A capping system according to claim 1 wherein the outer layer defines a cap base extending from the lip opposite the nozzles when the support is in the sealing position.

7. A capping system according to claim 6 wherein the cap base and the support define an expansion region therebetween into which the cap base expands when sealing the printhead.

8. A capping system according to claim 1 for sealing around ink-ejecting nozzles of plural printheads in an inkjet printing mechanism, comprising:

plural caps each extending from the support and each having (a) an outer layer which defines a hollow interior portion and (b) a brace portion inside the hollow interior portion, with each outer layer terminating in a lip having an exterior surface which surrounds the nozzles when the support is in the sealing position, and with each lip having an interior surface spaced apart from the brace portion when the support is in the rest position, and each lip interior surface approaches toward each associated brace portion when the support is in the sealing position.

9. A capping system according to claim 8 wherein:

said plural printheads are at different spacings from said support; and each lip interior surface approaches different distances toward each associated brace portion when the support is in the sealing position.

10. A method of sealing ink-ejecting nozzles of a printhead in an inkjet printing mechanism, comprising:

moving a cap between a sealing position and a rest position;

surrounding the nozzles with a lip portion of the cap when in the sealing position; and when moving the cap into the sealing position, compressing the lip portion into a hollow interior portion of the cap defined by an outer layer of the cap and toward a brace portion of the cap housed within the hollow interior portion.

11. A method according to claim 10 further including, when moving the cap into the sealing position, contacting the brace portion with the lip portion.

12. A method according to claim 11 further including, when moving the cap into the sealing position, compressing the brace portion with the lip portion.

13. An inkjet printing mechanism, comprising:

a support movable between a sealing position and a rest position;

a printhead supported by said support and having ink-ejecting nozzles;

a capping system for sealing around the ink-ejecting nozzles, comprising:

a cap extending from the support and having (a) an outer layer which defines a hollow interior portion and (b) a brace portion inside the hollow interior portion, with the outer layer terminating in a lip having an exterior surface which surrounds the nozzles when the support is in the sealing position, and with the lip having an interior surface spaced apart from the brace portion when the support is in the rest position, and the lip interior surface approaching toward the brace portion when the support is in the sealing position.

14. An inkjet printing mechanism according to claim 13 wherein the brace portion extends entirely under said lip.

15. An inkjet printing mechanism according to claim 13 wherein:

said outer layer defines a pair of opposing hollow interior portions; and the brace portion comprises a pair of brace portions each housed within an associated one of the pair of opposing hollow interior portion.

16. An inkjet printing mechanism according to claim 15 wherein said outer layer is solid under said lip between said pair of opposing hollow interior portions.

17. An inkjet printing mechanism according to claim 13 wherein:

the outer layer is of a first material having a first flexibility; and the brace portion is of a second material having a second flexibility which is less than said first flexibility.

18. An inkjet printing mechanism according to claim 13 wherein the outer layer defines a cap base extending from the lip opposite the nozzles when the support is in the sealing position.

19. An inkjet printing mechanism according to claim 18 wherein the cap base and the support define an expansion region therebetween into which the cap base expands when sealing the printhead.

20. An inkjet printing mechanism according to claim 13 for sealing around ink-ejecting nozzles of plural printheads in an inkjet printing mechanism, comprising:

plural caps each extending from the support and each having (a) an outer layer which defines a hollow interior portion and (b) a brace portion inside the hollow interior portion, with each outer layer terminating in a lip having an exterior surface which surrounds the nozzles when the support is in the sealing position, and with each lip having an interior surface spaced apart from the brace portion when the support is in the rest position, and each lip interior surface approaches toward each associated brace portion when the support is in the sealing position.

21. An inkjet printing mechanism according to claim 20 wherein:

said plural printheads are at different spacings from said support; and each lip interior surface approaches different distances toward each associated brace portion when the support is in the sealing position.

* * * * *